US005532201A

United States Patent [19]

Goto

[11] Patent Number: 5,532,201

[45] Date of Patent: Jul. 2, 1996

[54] THERMOSENSITIVE RECORDING MEDIUM

[75] Inventor: Hiroshi Goto, Fuji, Japan

[73] Assignee: Ricoh Company, Ltd., Tokyo, Japan

[21] Appl. No.: 355,974

[22] Filed: Dec. 14, 1994

[30] Foreign Application Priority Data

Dec. 15, 1993 [JP] Japan ..... 5-343114
Dec. 9, 1994 [JP] Japan ..... 6-331852

[51] Int. Cl.[6] ..... B41M 5/30; B41M 5/40

[52] U.S. Cl. ..... 503/213; 503/200; 503/201; 503/216; 503/226

[58] Field of Search ..... 427/150–152; 503/213, 200, 226, 225, 201, 213, 216

[56] References Cited

U.S. PATENT DOCUMENTS 3,861,941 1/1975 Brockett ..... 503/213

FOREIGN PATENT DOCUMENTS 63-265682 11/1988 Japan ..... 503/213
199873 4/1989 Japan ..... 503/213

*Primary Examiner*—B. Hamilton Hess
*Attorney, Agent, or Firm*—Oblon, Spivak, McClelland, Maier & Neustadt

[57] ABSTRACT

A thermosensitive recording layer is provided on a carrier body and is mainly composed of electron donative coloration compound, and electron acceptor compound, together with binder resin. The thermosensitive recording medium includes 500 through 5,000 ppm of organic solvent, and the organic solvent has a dielectric constant of 2.0 through 25.0 at 20° C., and has a steam pressure of 10 through 200 mmHg at 20° C. A protective layer is provided on the thermosensitive recording layer. The organic solvent is included in the thermosensitive layer and the protective layer.

9 Claims, 1 Drawing Sheet

| EVALUATION ITEM / SAMPLE | COLOR DEVELOPMENT COLOR TUNE | TRANSMISSION DENSITY | | TRANSPARENCY | | PRESERVATION PROPERTY | |
|---|---|---|---|---|---|---|---|
| | | BACK-GROUND PART | IMAGE PART | OHP ILLUMINANCE (LUX) | SPECTRAL TRANSMITTANCE (%) | BACK-GROUND PART | IMAGE PART |
| (NOTE 1) FIRST EMBODIMENT OF INVENTION | BLACK | 0.16 | 1.85 | – | – | 0.15 | 1.86 |
| SECOND EMBODIMENT OF INVENTION | BLACK | 0.22 | 1.21 | 303 | 53 | 0.21 | 1.01 |
| THIRD EMBODIMENT OF INVENTION | BLACK | 0.07 | 1.55 | 450 | 80 | 0.06 | 1.55 |
| FOURTH EMBODIMENT OF INVENTION | BLACK | 0.06 | 1.56 | 453 | 81 | 0.06 | 1.56 |
| FIFTH EMBODIMENT OF INVENTION | BLACK | 0.06 | 1.53 | 450 | 81 | 0.05 | 1.48 |
| SIXTH EMBODIMENT OF INVENTION | BLACK | 0.05 | 1.54 | 473 | 82 | 0.05 | 1.50 |
| (NOTE 1) FIRST COMPARISON EXAMPLE | BLACK | 0.18 | 1.86 | – | – | 0.18 | 1.86 |
| SECOND COMPARISON EXAMPLE | BLACK | 0.25 | 1.23 | 280 | 61 | 0.25 | 1.03 |
| THIRD COMPARISON EXAMPLE | BLACK | 0.10 | 1.55 | 420 | 78 | 0.095 | 1.55 |
| FOURTH COMPARISON EXAMPLE | BLACK | 0.095 | 1.57 | 425 | 78 | 0.095 | 1.56 |
| FIFTH COMPARISON EXAMPLE | BLACK | 0.05 | 1.49 | 472 | 82 | 0.05 | 1.21 |
| SIXTH COMPARISON EXAMPLE | BLACK | 0.51 | 1.58 | 250 | 50 | 0.52 | 1.56 |
| SEVENTH COMPARISON EXAMPLE | BLACK | 0.13 | 0.98 | 43 | 10 | 0.13 | 0.93 |

FIG. 1

| EVALUATION ITEM / SAMPLE | COLOR DEVELOPMENT COLOR TUNE | TRANSMISSION DENSITY | | TRANSPARENCY | | PRESERVATION PROPERTY | |
|---|---|---|---|---|---|---|---|
| | | BACK-GROUND PART | IMAGE PART | OHP ILLUMINANCE (LUX) | SPECTRAL TRANSMITTANCE (%) | BACK-GROUND PART | IMAGE PART |
| (NOTE 1) FIRST EMBODIMENT OF INVENTION | BLACK | 0.16 | 1.85 | — | — | 0.15 | 1.86 |
| SECOND EMBODIMENT OF INVENTION | BLACK | 0.22 | 1.21 | 303 | 53 | 0.21 | 1.01 |
| THIRD EMBODIMENT OF INVENTION | BLACK | 0.07 | 1.55 | 450 | 80 | 0.06 | 1.55 |
| FOURTH EMBODIMENT OF INVENTION | BLACK | 0.06 | 1.56 | 453 | 81 | 0.06 | 1.56 |
| FIFTH EMBODIMENT OF INVENTION | BLACK | 0.06 | 1.53 | 450 | 81 | 0.05 | 1.48 |
| SIXTH EMBODIMENT OF INVENTION | BLACK | 0.05 | 1.54 | 473 | 82 | 0.05 | 1.50 |
| (NOTE 1) FIRST COMPARISON EXAMPLE | BLACK | 0.18 | 1.86 | — | — | 0.18 | 1.86 |
| SECOND COMPARISON EXAMPLE | BLACK | 0.25 | 1.23 | 280 | 61 | 0.25 | 1.03 |
| THIRD COMPARISON EXAMPLE | BLACK | 0.10 | 1.55 | 420 | 78 | 0.095 | 1.55 |
| FOURTH COMPARISON EXAMPLE | BLACK | 0.095 | 1.57 | 425 | 78 | 0.095 | 1.56 |
| FIFTH COMPARISON EXAMPLE | BLACK | 0.05 | 1.49 | 472 | 82 | 0.05 | 1.21 |
| SIXTH COMPARISON EXAMPLE | BLACK | 0.51 | 1.58 | 250 | 50 | 0.52 | 1.56 |
| SEVENTH COMPARISON EXAMPLE | BLACK | 0.13 | 0.98 | 43 | 10 | 0.13 | 0.93 |

THERMOSENSITIVE RECORDING MEDIUM

FIELD OF THE INVENTION

1. Field of the Invention

The present invention relates to a thermosensitive recording medium which uses a color development reaction occurring between an electron donative coloration compound and an electron acceptor compound. (The electron donative coloration compound may be simply referred to as a color coupler, hereinafter. The electron acceptor compound may be referred to as a developer, hereinafter.) In particular, the present invention relates to the thermosensitive recording medium which is useful as a film sheet for image forming in an overhead projector (which will be abbreviated to an OHP, hereinafter), as a film sheet for image forming in a CAD (computer aided designing, and as a film for a video printer.

2. Prior Art

The thermosensitive recording medium which uses the color development reaction occurring between the color coupler and the developer has been well-known.

Recently, it has been demanded to use the thermosensitive recording medium for the OHP or as a a diazo mother print or as a design drawing.

Japanese Patent Application No.61-121875 and Japanese Laid-Open Application No.1-99873 propose transparent thermosensitive recording media, it being possible that a thermal head directly prints on the transparent thermosensitive recording media. However, a problem is present in manufacturing the transparent thermosensitive recording media. Specifically, in order to obtain the transparent thermosensitive recording media, the color coupler is microcapsulated, while the developer is dissolved in organic solvent which is slightly soluble or insoluble in water. As a result of performing emulsion dispersion of the thus-microcapsulated color coupler and the thus-dissolved developer, emulsion dispersion substance is obtained and an application liquid consisting of emulsion dispersion substance is thus obtained. The thus-obtained application liquid is applied or coated on a transparent carrier and thus the transparent thermosensitive recording medium is obtained. Thus, the manufacturing process is considerably complicate. Further, another problem of the transparent thermosensitive recording media is that an transparency of the transparent thermosensitive recording media is insufficient. Further, as another problem, it is not sufficiently possible to print on the transparent thermosensitive recording media through a heat transfer printer which is used for a personal word processor for popular use.

SUMMARY OF THE INVENTION

An object of the present invention is solve the above-mentioned problems present in the prior art and thus to provide the thermosensitive recording media, which use the reaction occurring between the color coupler and the developer and which has improved thermosensitivity, an improved color development image forming property, and, in particular, improved transparency.

According to the present invention, the thermosensitive recording medium is provided, which medium has a thermosensitive recording layer on a carrier body. The thermosensitive recording layer has main ingredients consisting of the electron donative coloration compound and the electron acceptor compound together with binder resin. The thermosensitive recording medium includes 500 through 5,000 ppm of organic solvent. The organic solvent has a dielectric constant of 2.0 through 25.0 at 20° C., and has steam pressure of 10 through 200 mmHg at 20° C.

That is, the present inventors have diligently conducted research for solving the above-mentioned problems. As a result, they have found that it is preferable that:

The thermosensitive recording medium has the thermosensitive recording layer on the carrier body, a main ingredient of the carrier body being resin. The thermosensitive recording layer has main ingredients consisting of the electron donative coloration compound and the electron acceptor compound together with binder resin. The thermosensitive recording medium includes 500 through 5,000 ppm of organic solvent. The organic solvent has dielectric constant of 2.0 through 25.0 at 20° C., and has steam pressure of 10 through 200 mmHg at 20° C. By using the above-described thermosensitive recording medium, remarkable features can be obtained as described below. It is possible to control an optical density of fresh one of the recording medium to be low and also, if the carrier body is transparent, transparency of the recording medium is improved. If it is demanded to further reduce the optical density of fresh one of the recording medium and/or to further improve the transparency thereof, it is effective to carry out aging of the recording medium under a temperature lower than a color development temperature thereof. Further, it is also found that manufacturing of the recording media is easy. Thus, the present invention has been completed.

A major amount of the organic solvent included in the thermosensitive recording medium according to the present invention is present in the thermosensitive recording layer. However, it is possible that a protective layer of the recording medium has an amount of the organic solvent present therein. However, making the organic solvent be included in the thermosensitive layer is effective for controlling the optical density of fresh one of the recording medium to be low. Further, since the carrier body is a carrier which is insoluble in the organic solvent, little amount of the organic solvent is present in the carrier body. Therefore, a content of the organic solvent included in the recording medium accordingly tells a content of the organic solvent which is included in the thermosensitive layer and protective layer but is not included in the carrier body.

A considerably large portion of cause which results in the optical density of fresh one of the thermosensitive recording medium according to the present invention to be high depends on the organic solvent included in the thermosensitive layer and protective layer. If the content of the organic solvent is lower than the above-mentioned 500 ppm, the optical density of fresh one of the recording medium is relatively high so that no significant effect can be obtained even if the above-mentioned aging is performed thereon. Further, if the content of the organic solvent exceeds the above-mentioned 5,000 ppm, it is possible to control the optical density of fresh one of the recording medium to be low. However, in such a state as that the organic solvent exceeds the above-mentioned 5,000 ppm, an image, which has been obtained as a result of color development image forming on the recording medium, can not be well preserved. Therefore, the content of the organic solvent is limited within an extent between 500 through 5,000 ppm.

Further, in view of appearance of effect, the present invention uses the organic solvent having dielectric constant of 2.0 through 25.0 at 20° C. and having steam pressure of 10 through 200 mmHg at 20° C., as will be mentioned later.

The thermosensitive recording medium will now be described in detail. It is noted that the above-described effect obtained from the organic solvent appears whether the thermosensitive recording medium is reversible one or irreversible one. However, this effect remarkably appears in particular if the thermosensitive recording medium is an irreversible transparent thermosensitive recording medium which is obtained as a result of stacking of recording layer and protective layer on a transparent one of the carrier body. The above-mentioned irreversible transparent thermosensitive recording medium will now be described.

The color coupler used in the present invention is dye precursor which is colorless or light color in itself and is not specifically limited. Well-known compounds which can be used for the color coupler are, for example: triphenylmethane phthalide compounds, fluoran compounds, phenothiazine compounds, leuco auramine compounds, rhodamine lactam compounds, spiro pyran compounds, indolino phthalide compounds.

The fluoran compounds are specially preferable to be used as the color coupler used in the present invention. Specific examples are listed below:

3, 6-dimethoxy fluoran,
3-cyclohexylamino-6-chlor fluoran,
3-dimethylamino-5, 7-dimethyl fluoran,
3-diethylamino-5, 7-dimethyl fluoran,
3-dimethylamino-7-chlor fluoran,
3-diethylamino-7-chlor fluoran,
3-dimethylamino-7-methyl fluoran,
3-diethylamino-7-methyl fluoran,
3-diethylamino-6-methyl-7-chlor fluoran,
3-diethylamino-6-methyl-7-brom fluoran,
3-di-n-butylamino-6-methyl-7-brom fluoran,
3-diethylamino-6-methyl-8-methyl fluoran,
3-di-n-butylamino-6-methyl-8-methyl fluoran,
3-diethylamino-7, 8-benzo fluoran,
3-di-n-butylamino-7, 8-benzo fluoran,
3-(N-n-butyl-N-methylamino)-7, 8-benzo fluoran,
3-(N-n-butyl-N-ethylamino)-7, 8-benzo fluoran,
3-(N-iso-butyl-N-ethylamino)-7, 8-benzo fluoran,
3-di-iso-butylamino-7, 8-benzo fluoran,
3-(N-iso-amyl-N-ethylamino)-7, 8-benzo fluoran,
3, 6-bis (diphenylamino) fluoran,
3, 6-bis (N-biphenyl-N-phenylamino) fluoran,
3-diethylamino-7-anylino fluoran,
3-di-n-butylamino-7-anylino fluoran,
3-(N-n-hexyl-N-ethylamino)-7-anylino fluoran,
3-diethylamino-7-dibenzylamino fluoran,
3-diethylamino-5-methyl-7-dibenzylamino fluoran,
3-diethylamino-7-piperidino fluoran, and so forth.

Further, other specific examples are listed below:

3-diethylamino-(O-chlor anilino) fluoran,
3-di-n-butylamino-7-(O-chlor anilino) fluoran,
3-dimethylamino-6-methyl-7-anilino fluoran,
3-diethylamino-6-methyl-7-anilino fluoran,
3-di-n-butylamino-6-methyl-7-anilino fluoran,
3-(N-n-propyl-N-methylamino)- 6-methyl-7-anilino fluoran,
3-(N-iso-propyl-N-methylamino)- 6-methyl-7-anilino fluoran,
3-(N-n-butyl-N-ethylamino)- 6-methyl-7-anilino fluoran,
3-(N-iso-butyl-N-methylamino)- 6-methyl-7-anilino fluoran,
3-(N-n-amyl-N-methylamino)- 6-methyl-7-anilino fluoran,
3-(N-iso-amyl-N-ethylamino)- 6-methyl-7-anilino fluoran,
3-(N-cyclohexyl-N-methyl)- 6-methyl-7-anilino fluoran,
3-(N-n-amyl-N-ethylamino)- 6-methyl-7-anilino fluoran,
3-(N-P-tolyl-N-ethylamino)- 6-methyl-7-anilino fluoran,
3-(N-2-ethoxy propyl-N-ethylamino)- 6-methyl-7-anilino fluoran,
3-pyrrolidino-6-methyl-7-anilino fluoran,
3-(N-tetrahydrofurfuryl-N-ethylamino)- 6-methyl-7-anilino fluoran,
3-diethylamino-7-(m-trifluoro methylanilino) fluoran,
3-diethylamino-6-methyl-7-(2', 4',-diethylanilino) fluoran,
3-diethylamino-6-chlor-7-anilino fluoran,
3-diethylamino-5-methyl-7-(α-phenyl ethylamino) fluoran,
3-(N-P-tolyl-N-ethylamino)-7-(α-phenyl ethylamino) fluoran, and so forth.

Organic phosphorus compounds are used as the developer for color developing of the above-mentioned color coupler in the present invention. In particular, phosphonic acid expressed by the following general chemical formula (I) or (II) is used:

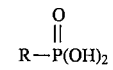

(I)

(In the above formula, the sign 'R' is referred alkyl group having 16 through 24 carbons.)

Compounds in specific examples of the above-mentioned phosphonic acid are listed below:

Hexadecyl phosphonic acid, octadecyl phosphonic acid, icocyl phosphonic acid, dococyl phosphonic acid, tetracocyl phosphonic acid, and so forth.

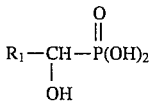

(II)

(In the above formula, the sign '$R_1$' is referred alkyl group having 13 through 23 carbons.)

Compounds in specific examples of the above-mentioned phosphonic acid are listed below:

α-hydroxy tetradecyl phosphonic acid, α-hydroxy hexadecyl phosphonic acid, α-hydroxy octadecyl phosphonic acid, α-hydroxy icocyl phosphonic acid, α-hydroxy dococyl phosphonic acid, α-hydroxy tetracocyl phosphonic acid, and so forth.

In the present invention, the developer is used, which developer consists of a single compound or consisting of mixture of a plural types of compounds. Similarly, the color coupler is used, which color coupler may consist of a single compound or mixture of a plural types of compounds.

A substance having an index of refraction of an extent between 1.45 through 1.60 in normal temperature and having a hydroxyl group in its molecular is used as the binder resin used in the thermosensitive recording layer. Specific examples of such binder resin are listed below: poly(vinyl butyral), poly(vinyl acetal), epoxy resin, ethyl cellulose, cellulose acetate, hydroxy propyl cellulose, ethyl hydroxy cellulose, and so forth.

In the present invention, in order to improve a coating property or a recording property, for example, dispersing agent, high-molecular cationic electrically conductive agent, color development image stabilizing agent, or the like may be included in the thermosensitive recording layer.

Further, in order to improve a light resistance property of the thermosensitive recording medium according to the present invention, light stabilization agent may be included in the thermosensitive recording layer. Ultraviolet ray absorbing agent, oxidation inhibiter, quencher of singlet oxygen, quencher of superoxido anion may be used as the above-mentioned light stabilization agent used in the present invention.

The carrier body of the thermosensitive recording medium according to the present invention is a carrier body mainly formed of a synthetic paper sheet, a metallic foil, and/or synthetic resin. Usually a transparent or opaque carrier body is used as the carrier body, the transparent or opaque carrier body consisting of one of a polyester film such as that of poly(ethylene terephthalate), poly(butylene terephthalate), or the like, a cellulose derivative film such as that of cellulose triacetate, or the like, a polyolefine film such as that of polypropylene, polyethylene, or the like, and a polystyrene film. Further, instead, the transparent or opaque carrier body is obtained as a result of pasting some of the above-listed films with one another.

The carrier body may comprise a transparent resin film having an index of refraction between 1.45 and 1.60 in normal temperature.

A thermosensitive recording medium, which does not have the protective layer therein, of the thermosensitive recording medium according to the present invention will now be described. In the thermosensitive recording layer of the thermosensitive recording medium, the developer is dispersed in the binder resin. However, the dispersion is not uniform in a surface portion and an internal portion of the layer. Further, voids are present in the recording layer and thus air present in the voids has an index of refraction different from an index of refraction of the recording layer itself and the refraction index difference causes light scattering. As a result, the recording layer is opaque. Such voids may be formed, for example, as a result of the organic solvent present in the recording layer being transformed into gas and then removed therefrom, or as a result of a space being defined between adjacent developer particles. However, by uniformly coating resin on the above-mentioned opaque recording layer and drying (curing) it, the voids present in and unevenness present on the recording layer are eliminated and thus the surface thereof is smoothed. As a result, the light scattering is reduced and thus transparent recording medium can be obtained. The above-mentioned resin has an index of refraction of 1.45 through 1.60 in normal temperature, the extent of which index is the same as that of the index of the binder resin. Thus, the protective layer is formed. The thus-formed protective layer not only contributes for making the recording medium be transparent but also has great effect to improve a chemical resistant property, a water proof property, a friction resistant property, a light proof property and a head matching property. The good head matching property means a state of a surface of the recording medium such as that a thermal head can smoothly slides on the surface of the recording medium. Further, the good head matching property means a state of the surface of the recording medium such that no sticking occurs, that is, the thermal head running on the surface of the recording medium does not cause the protective layer to be shaped nor cause the protective layer to crack. Thus, the protective layer is an essential element to obtain the transparent thermosensitive recording medium having a superior property.

In the protective layer in the present invention, the following elements are included: a coat mainly formed of water-soluble resin and hydrophobic resin, a coat mainly formed of ultraviolet ray setting resin or electron ray setting resin, and so forth. By forming such a protective layer, it is possible to obtain the recording medium which does not create substantial problems even after coming into contact with organic solvent, plasticizer, oil, sweat, water or the like. Further, by making organic or inorganic filler and lubricant be included in the protective layer, it is possible to eliminate problems of sticking which may occur as a result of a thermal head or the like coming into contact with the recording medium. Therefore, it is possible to obtain the thermosensitive recording medium having improved reliability and an improved head matching property.

Matters other than those regarding the transparent thermosensitive recording medium will now be described.

The color coupler used in the present invention is not specifically limited and may consist of one which was described in the description of the transparent thermosensitive recording medium. Compounds which may be used as the developer are, other than the organic phosphorus compounds described above, phenyl compounds which is relatively unlikely to be dissolved in the organic solvent. Specific examples thereof are derivatives of bis(hydroxyphenyl) acetic acid and derivatives of gallic acid. Substance to be used as the binder resin used in the thermosensitive recording medium may consist of resin which is dissolved in the organic solvent and becomes a film when it is coated and dried. Specific examples thereof are: poly(vinyl chloride) resin, ethylene-vinyl acetate copolymer, polystyrene, poly(vinyl acetate) resin, vinyl chloride-acetate copolymer, saturated polyester resin, polyurethan acryl resin, polycarbonate resin, and so forth. Other specific examples are those which were described in the description of the transparent thermosensitive recording medium.

In the present invention, it is possible to add additives which were described in the description of the transparent thermosensitive recording medium, if it is necessary.

The carrier body used in the present invention may consist of not only the transparent carrier body described above but also a synthesis paper sheet using a resin film, a white polyester film having inorganic substance added thereto, a foamed white polyester film or the like.

The protective layer in the present invention may also use the resins and additives described in the description of the transparent thermosensitive recording medium.

The organic solvent for dissolving the binder resin has dielectric constant of 2.0 through 25.0 at 20° C., and has steam pressure of 10 through 200 mmHg at 20° C. Specific examples of the organic solvent are listed below: kinds of ether such as dibutyl ether, isopropyl ether, dioxane, tetrahydrofuran, or the like, kinds of ketone such as aceton, diethyl ketone, methyl ethyl keton, methyl isobutyl ketone, methyl propyl ketone or the like, kinds of ester such ethyl acetate, isopropyl acetate, n-propyl acetate, n-butyl acetate, or the like, kinds of aromatic hydrocarbon such as benzen, toluene, xylene, or the like. In practice, one of them alone is used as the organic solvent for dissolving the binder resin, or combination of some of them is used for the same purpose.

No specific limitation is present in a method for coating of the protective layer and an amount of the coating.

However, in view of desirable performance of the protective layer and in an economic view point, an extent of coating thickness mentioned below is considered. That is, if the extent of coating thickness is such that the protective layer formed on the recording medium as a result of coating has a thickness in an extent between 0.1 μm and 20 μm, preferably a thickness in an extent between 0.5 μm and 10 μm, the desirable performance of the protective layer can be sufficiently exhibited and thus the desirable performance of the recording medium can be ensured.

A method of forming an image on the thermosensitive recording medium according to the present invention will now be described. The method depends on particular purposes of using the image formed on the recording media. The thermosensitive recording medium according to the present invention can be used for any image forming method of those such as a method using a heat pen, a method using a thermal head, a method using laser heating, a method using a thermal etching technique using light and so forth. However, the image forming method, for which the thermosensitive recording medium according to the present invention can be used, is not specifically limited to the above-mentioned methods. However, in practice, it is preferable that the thermosensitive recording medium according to the present invention is useful for being used in the image forming method using the thermal head and that using the thermal etching technique using light (white light including visible light and infrared light).

Other objects and further features of the present invention will become more apparent from the following detailed description when read in conjunction with the accompanying drawings.

BRIEF DESCRIPTION OF DRAWING

FIG. 1 shows evaluation results obtained from samples in embodiments according to the present invention and comparison examples.

DESCRIPTION OF PREFERRED EMBODIMENTS

The present invention will now be described in further detail using embodiments thereof. It is noted that each of units 'part' and '%' is that of weight basis.

A first embodiment according to the present invention will now be described.

Substance having the following composition will be dispersed through a portable ball mill and thus an average particle diameter of octadecyl phosphonic acid reaches approximately 0.4 μm:

3-dimethylamino-6-methyl-7-anilino fluoran . . . 10 parts, octadecyl phosphonic acid . . . 30 parts, poly(vinyl butyral) (Denka butyral #3000-2, manufactured by Denki Kagaku Kogyo Company) . . . 15 parts, and toluene/methyl ethyl keton (1/1) mixture liquid . . . 285 parts.

A coating liquid of the recording layer is thus prepared. The thus-prepared coating liquid of the recording layer is coated on a foamed white polyethylene film of 100 μm using a wire bar so as to result in a coated film thickness of approximately 6.0 μm, and the thus-coated liquid is dried. Thus, the thermosensitive recording medium is produced. While the drying, a condition in which the above-mentioned coated liquid is dried to provide the recording layer is adjusted so that a content of the organic solvent in the recording layer is approximately 1,000 ppm.

A second embodiment according to the present invention will now be described.

Substance having the following composition will be dispersed through a portable ball mill and thus an average particle diameter of bis(P-hydroxyphenyl) methyl ester acetate reaches approximately 1.2 μm:

3-di-n-butylamino-6-methyl-7-anilino fluoran . . . 10 parts, bis(P-hydroxyphenyl) methyl ester acetate . . . 30 parts, poly(vinyl acetate) . . . 25 parts, and xylene/methyl isobutyl ketone (7/3) mixture liquid . . . 275 parts.

A coating liquid of the recording layer is thus prepared.

By uniformly dispersing substance having the following composition, a coating liquid of the protective layer is prepared:

butyl acetate solution having therein 75% urethane acrylate ultraviolet ray setting resin, which consists of 25% of the butyl acetate solution and 75% of urethane acrylate ultraviolet ray setting resin (Unidick C7-157 manufactured by Dainippon Ink Kagaku Company) . . . 100 parts, xylene solution having therein 52% silicon resin, which consists of 48% of xylene solution and 52% of silicon resin (Byk-344 manufactured by Big Chemy Japan Company) . . . 4.5 parts, and ethyl acetate . . . 50 parts.

Using the above-prepared coating liquids, the transparent thermosensitive recording medium is produced as described below. The coating liquid of the recording layer is coated on a transparent polyester film of 100 μm using a wire bar so as to result in a coated film thickness of approximately 7.5 μm, and the thus-coated liquid is dried. Thus, the thermosensitive recording layer is formed.

Further, upon the thus-formed thermosensitive recording layer, the coating liquid of the protective layer is coated using a wire bar and dried. After that, a thus-coated and dried film is cured using an 80 W/cm ultraviolet ray lamp. Thus, a coated film thickness of approximately 5 μm constituting the protective layer is formed on the thermosensitive recording layer. Thus, the transparent thermosensible recording medium is produced. During the above-mentioned process, a conditions in which the above-mentioned coated liquids are dried to provide the recording layer and protective layer are adjusted so that a content of the organic solvent in the recording layer and protective layer is approximately 2,000 ppm.

A third embodiment according to the present invention will now be described.

Substance having the following composition will be dispersed through a portable ball mill and thus an average particle diameter of octadecyl phosphonic acid reaches approximately 0.3 μm (not including a particle having a diameter thereof equal to or larger than 1 μm):

3-diethylamino-6-methyl-7-anilino fluoran . . . 10 parts, octadecyl phosphonic acid . . . 30 parts, poly(vinyl butyral) (Denka butyral #3000-2, manufactured by Denki Kagaku Kogyo Company) . . . 15 parts, and toluene/methyl ethyl keton (1/1) mixture liquid . . . 285 parts.

A coating liquid of the recording layer is thus prepared.

By uniformly dispersing substance having the following composition, a coating liquid of the protective layer is prepared:

75% butyl acetate solution having therein urethane acrylate ultraviolet ray setting resin (Unidick C7-157 manufactured by Dainippon Ink Kagaku Company) . . . 100 parts, 52% xylene solution having therein silicon resin (Byk-344 manufactured by Big Chemy Japan Company) . . . 4 parts, and ethyl acetate . . . 50 parts.

Using the above-prepared coating liquids, the transparent thermosensitive recording medium is produced as described below. The coating liquid of the recording layer is coated on a transparent polyester film of 100 μm using a wire bar so as to result in a coated film thickness of approximately 6.0 μm, and the thus-coated liquid is dried. Thus, the thermosensitive recording layer is formed.

Further, upon the thus-formed thermosensitive recording layer, the coating liquid of the protective layer is coated using a wire bar and dried by heating. After that, a thus-coated and dried film is cured using an 80 W/cm ultraviolet ray lamp. Thus, a coated film thickness of approximately 5 μm constituting the protective layer is formed on the thermosensitive recording layer. Thus, the transparent thermosensitive recording medium is produced. During the above-described production process, a conditions in which the above-mentioned coated liquids are dried to provide the recording layer and protective layer are adjusted so that a content of the organic solvent in the recording layer and protective layer is approximately 2,200 ppm.

A fourth embodiment of the present invention will now be described.

The transparent thermosensitive recording medium in the above-described third embodiment is then preserved in a thermostat for 12 hours under 40° C. Thus, the transparent thermosensitive recording medium in the fourth embodiment is obtained.

A fifth embodiment of the present invention will now be described.

According to a method similar to one described in the description of the above-described third embodiment, the coating liquids are prepared and the recording medium is produced. However, the conditions in which the above-mentioned coated liquids are dried to provide the recording layer and protective layer are differently adjusted so that a content of the organic solvent in the recording layer and protective layer is approximately 4,300 ppm. Thus, the transparent thermosensitive recording medium in the fourth embodiment is produced.

A sixth embodiment of the present invention will now be described.

The transparent thermosensitive recording medium in the above-described fifth embodiment is then preserved in a thermostat for 12 hours under 40° C. Thus, the transparent thermosensitive recording medium in the sixth embodiment is obtained.

A first comparison example will now be described.

According to a method similar to one described in the description of the above-described first embodiment, the coating liquid is prepared and the recording medium is produced. However, the condition in which the above-mentioned coated liquid is dried to provide the recording layer is differently adjusted so that a content of the organic solvent in the recording layer is approximately 350 ppm. Thus, the thermosensitive recording medium in the first comparison example is produced.

A second comparison example will now be described.

According to a method similar to one described in the description of the above-described second embodiment, the coating liquids are prepared and the recording medium is produced. However, the conditions in which the above-mentioned coated liquids are dried to provide the recording layer and protective layer are differently adjusted so that a content of the organic solvent in the recording layer and protective layer is approximately 450 ppm. Thus, the transparent thermosensitive recording medium in the second comparison example is produced.

A third comparison example will now be described.

According to a method similar to one described in the description of the above-described third embodiment, the coating liquids are prepared and the recording medium is produced. However, the conditions in which the above-mentioned coated liquids are dried to provide the recording layer and protective layer are differently adjusted so that a content of the organic solvent in the recording layer and protective layer is approximately 480 ppm. Thus, the transparent thermosensitive recording medium in the third comparison example is produced.

A fourth comparison example will now be described.

The transparent thermosensitive recording medium in the above-described third comparison example is then preserved in a thermostat for 12 hours under 40° C. Thus, the transparent thermosensitive recording medium in the fourth comparison example is obtained.

A fifth comparison example will now be described.

According to a method similar to one described in the description of the above-described third embodiment, the coating liquids are prepared and the recording medium is produced. However, the conditions in which the above-mentioned coated liquids are dried to provide the recording layer and protective layer are differently adjusted so that a content of the organic solvent in the recording layer and protective layer is approximately 6,000 ppm. Thus, the transparent thermosensitive recording medium in the fifth comparison example is produced.

A sixth comparison example will now be described.

According to a method similar to one described in the description of the above-described third embodiment, the coating liquids are prepared and the recording medium is produced, except for the following matter: Instead of the use of the toluene/methyl ethyl keton (1/1) mixture liquid, toluen/ethanol (with a dielectric constant of 27.0 at 20° C. and with a steam pressure of 44 mmHg at 20° C.) (1/1) mixture liquid is used. Thus, the thermosensitive recording medium in the sixth comparison example is produced.

A seventh comparison example will now be described.

According to a method similar to one described in the description of the above-described third embodiment, the coating liquids are prepared and the recording medium is produced, except for the following matter: Instead of the use of the toluene/methyl ethyl keton (1/1) mixture liquid, n-hexane (with a dielectric constant of 1.85 at 20° C. and with a steam pressure of 155 mmHg at 20° C.) / n-butanol (with a dielectric constant of 19.2 at 20° C. and with a steam pressure of 5.5 mmHg at 20° C.) (1/1) mixture liquid is used. Thus, the thermosensitive recording medium in the seventh comparison example is produced.

An evaluation test is performed on the thermosensitive recording medium in each of the above-described first, second, third, fourth, fifth, sixth embodiments according to the present invention, and first, second, third, fourth, and fifth comparison examples. The evaluation test is such that a printing device using a thermal head of 8 dots/mm prints an image on the thermosensitive recording medium. In the printing, energy is applied to the recording medium such that power of 0.7 W/dot is applied and the power is applied for each pulse span of 0.5 msec. Items of the evaluation test will now be described.

Color Development Color Tone

A color development color tone appearing immediately after the printing is directly observed.

Transmission Density

An image part (optical) density and a background part (optical) density are measured immediately after the printing using a transmission density meter, X-Rite 310TR (manufactured by XRITE COMPANY).

Transparency

1) A transparency of the transparent thermosensitive recording medium is measured using a Ricoh Reflection-type OHP 312R. The measuring is made by actually projecting the printed image through the OHP and an illuminance (lux) obtained as a result of the projection is measured. In order to compare the results of the above-describing measurement performed on actual samples of the thermosensitive recording media, we performed the same measuring on a transparent PET (poly(ethylene terephthalate)) film (1000 μm). The measurement result of the transparent PET film is an illuminance of 500 luxes.

2) The transparency of the transparent thermosensitive recording medium is evaluated using a spectral transmittance thereof. A spectrophotometer UV-3100 manufactured by Shimazu Corporation is used for measuring the spectral transmittance with a spectral wavelength of 570 mm.

Preservation Property

1) Heat resistance property: The thermosensitive recording medium is preserved for 24 hours under 40° C. in dry condition. Then, the densities of the image part and background part are measured and thus evaluated.

The results of the above-described items of the evaluation test performed on the thermosensitive recording media in the embodiments according to the present invention and those in the comparison examples are shown in FIG. 1.

Note 1) Since the carrier body is not transparent one in each of the first embodiment according to the present invention and the first comparison example, a Macbeth illuminometer, RD-914 was used to measure the densities of the image parts obtained as a result of the color development.

Note 2) The content of the solvent included in the recording layer or that included in the recording layer and protective layer of the thermosensitive recording medium of each of the samples used in the above-mentioned evaluation test was measured by using a pyrolysis gas chromatograph (GC- 17A manufactured by Shimazu Corporation)

According to the present invention, a fixed content of the organic solvent is included in the recording layer and protective layer of the thermosensitive recording medium. As a result, it is possible to reduce an optical density of fresh one of the thermosensitive recording medium. Further, it is possible to remarkably improve contrast between the image part obtained as a result of the color development and the background part consisting of a remaining part of the fresh recording medium.

Further, the present invention is not limited to the above-described embodiments, and variations and modifications may be made without departing from the scope of the present invention.

What is claimed is:

1. A thermosensitive recording medium comprising:

a carrier body: and a thermosensitive recording layer provided on said carrier body, said thermosensitive recording layer mainly composed of electron donative coloration compound, and electron acceptor compound, together with binder resin;

and wherein said thermosensitive recording medium includes 500 through 5,000 ppm of organic solvent, said organic solvent having a dielectric constant of 2.0 through 25.0 at 20° C., and having a steam pressure of 10 through 200 mmHg at 20° C.

2. The thermosensitive recording medium according to claim 1, further comprising a protective layer provided on said thermosensitive recording layer.

3. The thermosensitive recording medium according to claim 2, wherein said organic solvent is included in said thermosensitive layer and said protective layer.

4. The thermosensitive recording medium according to claim 2, wherein said protective layer comprises a resin as a main ingredient thereof, said resin having an index of refraction between 1.45 and 1.60 in normal temperature.

5. The thermosensitive recording medium according to claim 1, wherein:

said electron acceptor compound comprises organic phosphorus compound expressed by a general formula (I):

$$R-\overset{\overset{\displaystyle O}{\|}}{P}(OH)_2, \qquad \text{(I)}$$

said R being an alkyl group having 16 through 24 carbons, or a general formula (II):

$$R_1-\underset{\underset{\displaystyle OH}{|}}{CH}-\overset{\overset{\displaystyle O}{\|}}{P}(OH)_2, \qquad \text{(II)}$$

said $R_1$ being an alkyl group having 13 through 23 carbons.

6. The thermosensitive recording medium according to claim 1, wherein said carrier body is insoluble in said organic solvent.

7. The thermosensitive recording medium according to claim 6, wherein said carrier body comprises a transparent resin film having an index of refraction between 1.45 and 1.60 in normal temperature.

8. The thermosensitive recording medium according to claim 1, wherein said carrier body comprises a transparent resin film having an index of refraction between 1.45 and 1.60 in normal temperature.

9. The thermosensitive recording medium according to claim 1, wherein said binder resin of said thermosensitive recording layer is a transparent resin having (1) an index of refraction between 1.45 and 1.60 in normal temperature and (2) a hydroxyl group or a carboxyl group.

* * * * *